US009153898B2

(12) United States Patent
Dendas et al.

(10) Patent No.: US 9,153,898 B2
(45) Date of Patent: Oct. 6, 2015

(54) SHIELDED ENCLOSURE ASSEMBLY FOR AT LEAST ONE IN PARTICULAR STANDARDIZED CONNECTOR ON A CABLE

(71) Applicant: TYCO ELECTRONICS NEDERLAND BV, 'S-Hertogenbosch (NL)

(72) Inventors: Freddy Jean Philip Dendas, Genk (BE); Thomas Taake De Boer, Nijmegen (NL)

(73) Assignee: TE Connectivity Nederland B.V., 'S-Hertogenbosch (NL)

( * ) Notice: Subject to any disclaimer, the term of this patent is extended or adjusted under 35 U.S.C. 154(b) by 241 days.

(21) Appl. No.: 13/644,544

(22) Filed: Oct. 4, 2012

(65) Prior Publication Data

US 2013/0084747 A1 Apr. 4, 2013

(30) Foreign Application Priority Data

Oct. 4, 2011 (EP) ..... 11183866

(51) Int. Cl.

| | |
|---|---|
| ***H01R 13/648*** | (2006.01) |
| ***H01R 13/516*** | (2006.01) |
| ***H01R 13/6593*** | (2011.01) |
| ***H01R 13/6581*** | (2011.01) |

(52) U.S. Cl.

CPC ..... *H01R 13/516* (2013.01); *H01R 13/6581* (2013.01); *H01R 13/6593* (2013.01)

(58) Field of Classification Search

USPC ..... 439/607.41, 0.44, 0.45, 0.5, 939

See application file for complete search history.

(56) References Cited

U.S. PATENT DOCUMENTS 4,810,210 A * 3/1989 Komatsu ..... 439/607.4
5,055,068 A * 10/1991 Machura et al. ..... 439/581

(Continued)

FOREIGN PATENT DOCUMENTS

DE 4107714 C1 7/1992
EP 0 111 62 A1 6/1984

(Continued)

OTHER PUBLICATIONS

Search Report issued by the European Patent Office, dated Feb. 27, 2012, for Priority Application No. EP 11183866.0; 7 pages.

*Primary Examiner* — Hien Vu

(74) *Attorney, Agent, or Firm* — Faegre Baker Daniels LLP

(57) ABSTRACT

The invention relates to an enclosure assembly for at least of a variety of in particular standardized connectors on a cable, such as RJ45, HDMI and others. The enclosure assembly has a connector volume located within an inner body of the enclosure assembly. The connector volume is adapted to moveably accommodate the connector. The inner body is open to an outer environment and a forward and a rearward end. The enclosure assembly further includes an outer body adapted to slide over the inner body in a forward direction. The outer body is provided with at least one locking element for securing the enclosure assembly to a mating enclosure. As a further improvement to the known connector assemblies, the connector volume is located within an electromagnetic shielding structure and the electromagnetic shielding structure is located within the inner body. According to a further embodiment, the electromagnetic shielding structure comprises a fixed shielding substructure and a moveable shielding substructure, which may be automatically connected to each other upon movement of the inner body in the forward direction.

19 Claims, 12 Drawing Sheets

(56) References Cited

U.S. PATENT DOCUMENTS

| | | | | |
|---|---|---|---|---|
| 5,465,313 | A | 11/1995 | Belenkiy et al. | |
| 5,618,208 | A * | 4/1997 | Crouse et al. | 439/607.17 |
| 6,583,352 | B2 * | 6/2003 | Fukushima et al. | 174/373 |
| 6,752,026 | B1 * | 6/2004 | Hyde | 73/861.15 |
| 7,316,583 | B1 | 1/2008 | Mistarz | |
| 7,338,214 | B1 | 3/2008 | Gurreri et al. | |
| 8,251,748 | B2 * | 8/2012 | Tyler et al. | 439/607.52 |
| 8,568,167 | B2 * | 10/2013 | Montena | 439/584 |
| 8,672,705 | B2 * | 3/2014 | Schneider | 439/460 |
| 2004/0038588 | A1 | 2/2004 | Bernardi et al. | |
| 2006/0211293 | A1 | 9/2006 | Li et al. | |
| 2007/0110385 | A1 | 5/2007 | Shakeri et al. | |
| 2009/0173518 | A1 | 7/2009 | Flagler | |
| 2010/0261367 | A1 * | 10/2010 | Billman et al. | 439/271 |

FOREIGN PATENT DOCUMENTS

| | | | |
|---|---|---|---|
| EP | 2 302 431 | A1 | 3/2011 |
| EP | 2 354 825 | A1 | 8/2011 |
| GB | 635089 | A | 4/1950 |
| GB | 2 028 009 | A | 2/1980 |

* cited by examiner

SHIELDED ENCLOSURE ASSEMBLY FOR AT LEAST ONE IN PARTICULAR STANDARDIZED CONNECTOR ON A CABLE

FIELD OF THE INVENTION

The invention relates to an enclosure assembly for at least one of a variety of in particular standardized connectors on a cable, the enclosure comprising a connector volume located within an inner body of the enclosure assembly, the connector volume being adapted to moveably accommodate the connector, the inner body being open to an outer environment in a forward and rearward direction, and an outer body adapted to slide over the inner body in the forward direction, the outer body comprising at least one locking element for securing the enclosure assembly to a mating enclosure in the forward position.

Such an enclosure assembly is e.g. known from European patent applications EP 09 012 270 (Publication No. EP 2 302 431 A) and EP 10 001 103 (Publication No. EP 2 354 825 A1). The enclosure assembly constitutes a protective shell around the preferably standardized connector, which may be a RJ45, HSIO, ampmodu, HDMI or any other standardized connector. The connector volume is both large enough to allow accommodation of various sizes of connectors for multiple connectors in a side-by-side arrangement without the need to change the inner and/or outer body of the enclosure assembly. Thus, the same enclosure assembly may be used for different connectors.

The connector volume is of sufficient size to allow a moveable accommodation, i.e. the connector is free to move within the connector volume. Thus, the position of the connector within the connector volume may be changed and tolerances can be compensated and both the enclosure assembly. Both the connector can be safely mated with their respective counterparts.

Full reference is made to the complete disclosure of European patent applications EP 09 012 270 and EP 10 001 103 with respect to the enclosure assembly, its components, advantages, and various embodiments and features. Both applications are herewith incorporated by reference.

In the following, the direction "forward" is defined for the enclosure assembly as facing in the direction of the optional mating enclosure, or the end of the cable, as seen from the enclosure assembly. The direction "rearward" designates the opposite direction, i.e. the direction facing away from the optional mating enclosure. If the enclosure assembly is mounted or being mounted on a cable, the forward and rearward direction run parallel to the cable.

Other enclosures are known from e.g. U.S. Pat. No. 7,338,214 B1. In this reference, the inner body is shown to be configured as a plug body and the outer body as a shell, which has a bayonet-style locking section. In the plug body and the mating enclosure, standardized connectors are fixably mounted at a predetermined position within the enclosure.

US 2009/173518 A1 shows a strain relief for medical devices. The strain relief can be secured to a frame of the medical device by sliding the strain relief into the frame, until a detent feature at the strain relief engages a complementary capture feature at the frame of the medical device. Extensions can be inserted into a complementary frame slot of the frame to align the strain relief. The outer shape of the extensions and of the strain relief is shaped conical and fits into a conical inner shape of the frame.

US 2006/211293 A1 discloses an electrical connector having a single piece insulated coating. Openings in the coating serve to receive operation portions at latch arms to build up a positive lock, a cable outlet serves to receive a strain relief member. When the insulated coating is assembled, the rear wall of the coating deflects the projecting portion and finally is confined by the front surface of the projection portion.

A strain relief for insertion into an enclosure is described in US 2007/110385 A1, which has a recess portion for engaging with an edge of an opening in the enclosure. For mounting the strain relief, a boot body is passed through the opening in the enclosure until the recess portion engages with the opening by a positive lock.

A self-locking strain relief bushing is described in GB 635 089 A, which consists of two parts. The two parts can be stuck together to a clamp a cable. Tapered outer surfaces on the bushings serve to ease assembling the two-part bushing into an opening of a mounting plate. The bushing can be moved into the opening up to a position, at which grooves in parts of the strain relief engage with an edge of the hole of the mounting plate by a positive lock.

GB 2 028 009 A describes an electric lead cable which is provided with an over-moulded strain relief. The strain relief has a groove for positive-fitting the receiving edges of an aperture.

In U.S. Pat. No. 5,465,313 A an optical fibre connector is disclosed which has a strain relief boot for surrounding a fibre optic cable. The strain relief boot serves for receiving a rearwardly extending barrel portion of a housing and can be mounted on the barrow portion by sliding the strain relief boot in a forward direction up to a position, in which a snap-on connection between the barrel portion and the strain relief boots snaps in place.

The enclosure assembly known especially from EP 09 012 270 and EP 10 001 103 is particularly advantageous to give additional protection to the connector received within. It is therefore preferably used in harsh environments, such as in outdoor applications.

SUMMARY

It is an object of the present invention to further improve the protection of the connector within the enclosure assembly against the environment.

This object is reached according to the invention for an enclosure assembly as mentioned in the beginning in that the connector volume is located within an electromagnetic shielding structure, the electromagnetic shielding structure being located within the inner body.

The enclosure assembly according to the invention thus provides not only protection against mechanical hazards but also protection against electromagnetic fields and lightning strikes. It is to be noted in this context that the connector located within the connector volume is, in most cases, already provided with shielding according to the specification of the respective standard. The enclosure assembly adds extra protection without limiting the movability of the connector within the connector volume. By locating the electromagnetic shielding structure within the inner body, the interaction of the inner and outer body, as e.g. known from EP 09 012 270 and EP 10 001 103, remains unchanged. Further, by being located within the inner body, the electromagnetic shielding structure constitutes an additional barrier against mechanical impact after the outer and inner body have failed. Finally, in that the connector volume is arranged within the electromagnetic shielding structure, the latter has to have a large diameter at least compared to the shielding provided by the connector. The large diameter leads to large conductive cross-sectional areas and thus to particularly low electric resistance volumes.

The enclosure assembly according to the invention is particularly suited for power connectors, copper connectors, and may also be used for fibre connectors, and combinations of these connectors, etc.

In the following, further improvements of the enclosure assembly according to the invention are described. These additional improvements may be combined independently of each other, depending on whether a particular advantage of a particular improvement is needed in a specific application.

According to a first advantageous improvement, the electromagnetic shielding structure may at least in parts be adapted to be slid over by the inner body in the forward direction. This adaptation of the electromagnetic shielding structure has the advantage that the electromagnetic shielding structure may be mounted at the end of the cable with the inner and outer body being located at a rearward position on the cable. Thus, the inner and, possibly, outer body do not interfere with mounting at least those parts of the electromagnetic shielding structure that are configured to be slid over by the inner body.

The electromagnetic shielding structure may preferably comprise solid wall sections to enhance protection of the connector within the connector volume. The solid walls may in particular have no gaps and/or gaps that are smaller than approximately a tenth of the wavelength of the highest electromagnetic frequency that is, according to the respective standard, to be transmitted by the connector located in the connector volume.

The electromagnetic shielding structure and any parts thereof may be made from an electrically conductive, preferably ferromagnetic material of preferably low remanence. The electromagnetic shielding structure may in particular be, at least partly, made from a material containing bronze, in particular phosphor bronze that may be plated with nickel.

According to a further advantageous embodiment, the electromagnetic shielding structure is made from one or more essentially tubular solid wall elements. The solid wall effects a large conductive cross-section of the electromagnetic shielding structure. The tubular cross-section results in an improved mechanical protection by adding another mechanically rigid shell to the enclosure assembly.

According to another advantageous improvement, the electromagnetic shielding structure may comprise a moveable shielding substructure, which is adapted to be held, at least with respect to a movement of the inner body towards the forward position and/or the forward direction, by the inner body. This configuration facilitates handling and assembling of the enclosure assembly on the cable, as the moveable shielding substructure may be moved together with the inner body. In particular, the moveable shielding substructure may be preassembled with the inner body before the inner body is slid in the forward direction. Thus, the inner body and the moveable shielding substructure may be handled as a unit.

The moveable shielding substructure may in particular comprise a solid-walled part as described above.

It is of advantage if, according to another embodiment, the electromagnetic shielding structure comprises a fixed shielding substructure which is adapted to be fixed on the cable and to be slid over by a moveable substructure of the electromagnetic shielding structure in the forward direction. In this configuration, the electromagnetic shielding structure essentially mirrors the structure of the enclosure assembly by providing a part to be mounted on the cable and a part to be moved along the cable. Thus, sufficient space is provided to assemble the fixed shielding substructure and/or the connector on the cable. Once the fixed shielding substructure and preferably also the connector are in place, the moveable shielding substructure is pushed over the fixed shielding substructure. The fixed shielding substructure is preferably at least indirectly in electrical contact with a cable shield. The fixed shielding substructure may also comprise a solid-walled part in one of the above-described configurations. In an operative position, in which the enclosure assembly may be connected to a mating enclosure, the fixed shielding substructure may be located rearward of the moveable shielding substructure and/or at a rearward end of the connector volume.

Further, the fixed shielding substructure may form a stop for the inner body in the forward direction. Thus, the inner body may not inadvertently fall off the cable once the fixed shielding substructure is fixed on the cable. This facilitates the handling of the enclosure assembly.

Operation of the enclosure assembly may be facilitated if, according to another advantageous embodiment, the moveable and the fixed shielding substructures are automatically connected to each other in an electrically conductive manner during a movement of the inner body in the forward direction, such as a movement into the operation position. Here, an operator does not need to care about connecting the moveable and the fixed shielding substructure in the field, as this connection is established once the inner body is moved forward towards its operating position. The connection of the fixed and the moveable shielding substructure may be located at a removal section and/or end of the connector volume, preferably outside the connector volume.

The connection between the moveable and the fixed shielding substructures may be established by at least one preferably radially deflectable contact spring. In order to provide a large conductive cross-section, a low DC impedance, a plurality of contact springs is preferred. The contact springs may in particular be arranged in a ring-like fashion so that they exert a self-centring force upon engagement of the moveable and fixed shielding substructures. The contact springs may be made from a material combining copper and may be nickel-plated.

In order for the moveable shielding substructure to be slid over the fixed shielding substructure in the forward direction, the moveable shielding substructure may have a smaller diameter than the fixed shielding substructure.

To facilitate self-centering of the moveable shielding substructure, with or without being in combination with the inner body, the fixed shielding substructure may comprise a frustoconical outer wall section, which allows a progressive engagement of the contact springs between the fixed and the moveable shielding substructures.

According to another advantageous embodiment, the electromagnetic shielding structure may form a rearward wall of the connector volume, to improve the shielding effectiveness. In particular, the fixed magnetic shielding structure may have a tapering, in particular frustoconical wall section, thus creating a transition portion, in which the diameter of the fixed shielding substructure increases from approximately the cable diameter to approximately the inner diameter of the connector volume. This tapering section may form the rearward wall of the connector volume and/or the stop for the inner body.

The rearward wall may be formed by a substructure of the electromagnetic shielding structure, preferably the fixed shielding substructure, which is adapted to be fixed on the cable. This may be further developed in that the rearward wall may in particular form the stop for the inner and/or outer body as described above.

To complete the shielding of the connector and its counterpart, an electrically conductive connection has to be made between the shielding of the enclosure assembly according to the invention and the mating enclosure. For this, the electromagnetic shielding structure may comprise, at its forward end, at least one contact spring. This at least one contact spring may be configured such as the contact spring described above in the context of the electrical connection between the fixed and moveable shielding substructure. However, for the at least one contact spring being provided at the forward end, there is no need that at least one contact spring or a division of the shielding structure into a fixed and moveable shielding substructure is present.

In particular, the contact springs may be part of a ring-like element, which is mounted on the ends of the moveable shielding substructure. It is preferred that the diameter, at which the contact springs are located, is the same or at least almost the same at both the forward and rearward end, so that the conductive cross-section along the contact spring is as large as possible. The diameter, at which the spring contacts are arranged, may in particular closely correspond to the inner diameter of the connector volume.

The at least one contact springs at the forward end may point outwards, so that they do not project into the connector volume, where they may interfere with the freely moveable connector.

To keep the design of the fixed shielding substructure simple, the moveable shielding substructure may be provided with contact springs at its forward and rearward end.

The electromagnetic shielding structure, in particular the fixed shielding substructure, if present, may be connected at its rearward end to the cable shield in an electrically conductive manner.

At its rearward section, the electromagnetic shielding structure, in particular the fixed shielding substructure may be held on the cable, in particular by a strain relief section of the enclosure assembly. The strain relief section may be overmoulded over a rear part of the electromagnetic shielding structure, to keep it firmly in place.

According to another advantageous embodiment, the electromagnetic shielding structure may comprise a shielding ferrule, which at its rearward end, is in contact with the cable shield. The shielding ferrule may form a rearward part or section of the electromagnetic shielding structure and in particular be a part of the fixed shielding substructure. The shielding ferrule may taper in a rearward direction. It may further be fixed to the cable at its rearward end, preferably by a strain relief of the enclosure assembly.

Further, the electromagnetic shielding structure may, in particular the fixed shielding substructure, comprise a shielding sleeve, which is mounted on the cable and located between two layers of cable shielding material. By the shielding sleeve, the cable is rigidified and the electrical connection between the electromagnetic shielding structure and the cable shield is stabilized. In particular, the shielding sleeve may be located between two layers of the cable shield, the outer layer of the cable shield being a folded-over part of the inner layer.

The shielding sleeve and the remaining electromagnetic shielding structure, or the remaining fixed shielding substructure, are dimensioned so that the shielding sleeve may be accommodated within a rearward end of the remaining electromagnetic shielding structure. A corresponding gap between the sleeve and the remaining structure has a such a radial width which is larger than a single and, preferably, less than the five-fold thickness of the cable shield. This dimension of the gap enables a smooth sliding motion of the remaining shielding structure even if the cable shield is located on the outer surface of the shielding sleeve. At the same time, contact between the cable shield and the remaining electromagnetic shielding structure is ensured.

In operation, the remainder of the electromagnetic shielding structure may be plastically deformed, e.g. crimped, about the shielding sleeve to ensure a positive or a friction lock. To compensate for tolerances, it is preferred, however, that the shielding sleeve retains a certain amount of movability with respect to the remainder of the electromagnetic shielding structure. Thus, it is preferred that the plastic deformation is restricted to the remainder of the shielding structure, whereas the shielding sleeve remains substantially undeformed. Thus, the shielding sleeve itself is held by friction lock and is still moveable with respect to the cable. The cable shield that has been folded back or, alternatively, a separate element forms a conductive element between the sleeve and the ferrule to allow this movability.

Both the shielding sleeve and the shielding ferrule may constitute the fixed shielding substructure of the electromagnetic shielding structure. In this combination, the shielding sleeve stabilizes the connection of the shielding ferrule with the cable shield and the shielding ferrule may be used to increase the diameter of the fixed shielding substructure so that the connection between the fixed and the moveable shielding substructure takes place at the largest diameter possible.

In an alternate embodiment, the shielding ferrule may be integrated into the moveable shielding substructure.

In another advantageous embodiment, which may be an invention of its own, an alignment adapter is held within the connector volume, the adapter providing a complementary receptacle for the at least one connector. This increases mechanical stability of the connector, which is now fixed within the connector volume. The adapter may be arranged within the electromagnetic shielding structure to profit from the electromagnetic shielding. The adapter may be made from a dielectric material such as a plastic material.

The adapter may completely fill out the front opening of connector volume, so that no dirt may enter the connector volume.

Finally, a dust cap for an enclosure assembly may also be provided. The enclosure assembly may be configured as described above. The dust cap may have a pot-like electromagnetic shielding structure that is located within in a cap housing. The shielding structure of the cap is preferably adapted to automatically connect to the shielding structure of the enclosure assembly upon engagement with the enclosure assembly. The electromagnetic shielding structure of the dust cap may in particular comprise a ring-like contact spring element as described above for the enclosure assembly.

In the following, the invention and its improvements are described in greater detail using an exemplary embodiment and with reference to the drawings. As described above, the various features shown in the embodiment may be used independently of each other in specific applications.

DETAILED DESCRIPTION

Figure 1:
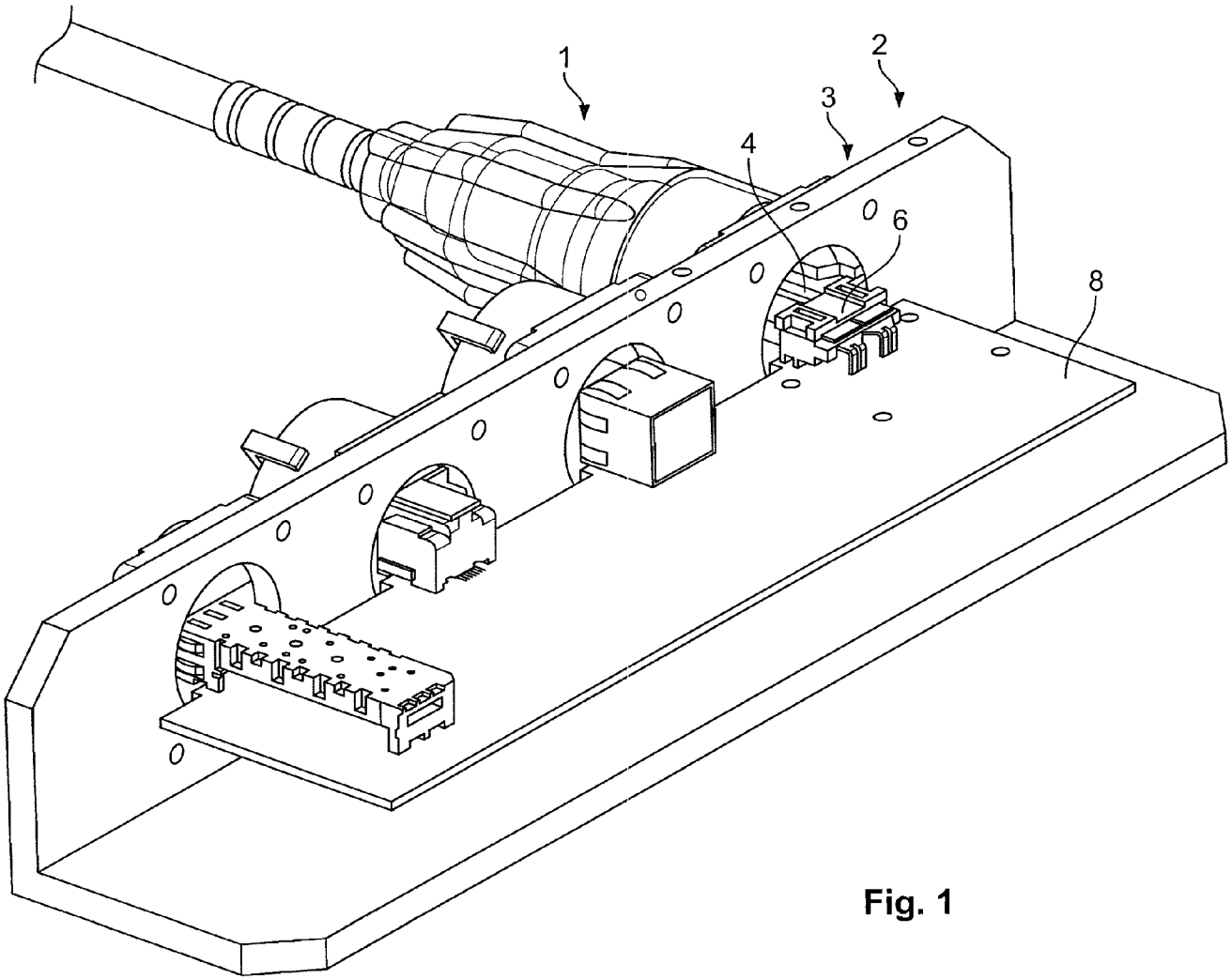
FIG. 1 shows a schematic and perspective rendition of an enclosure assembly according to the invention in operation.

FIG. 1 shows an enclosure assembly 1 according to the invention, as it is mounted on a cabinet 2 of e.g. a telecommunication facility. The enclosure assembly 1 is locked together with a mating enclosure 3, e.g. a bulkhead. The enclosure assembly contains a preferably standardized connector 4 which is connected to a mating connector 6 on e.g. a printed circuit board 8 or another electronic component.

As shown in FIG. 1, various types of standardized connectors respectively mating connectors may be accessed via the bulkhead 2. The enclosure assembly 1 is adapted to contain, without any modifications to its structure, any of these connectors, such as RJ45, USB, HDMI, FO, AMPMODU, HSIO, or any other type of connectors for power and/or data transmission.

The general structure and configuration of the enclosure assembly 1 is known e.g. from European patent applications EP 09 012 270 and EP 10 001 103, which are, in their respective entirety, incorporated by reference.

The enclosure assembly 1 according to the invention deviates from these known enclosure assemblies in that an electromagnetic shielding structure is provided. This results in modifications which are explained hereinafter.

The configuration of an exemplary embodiment of the enclosure assembly 1 according to the invention is best explained by looking at the steps that are performed when the enclosure assembly is put together. These steps are shown in FIGS. 2 to 10.

Figure 2:
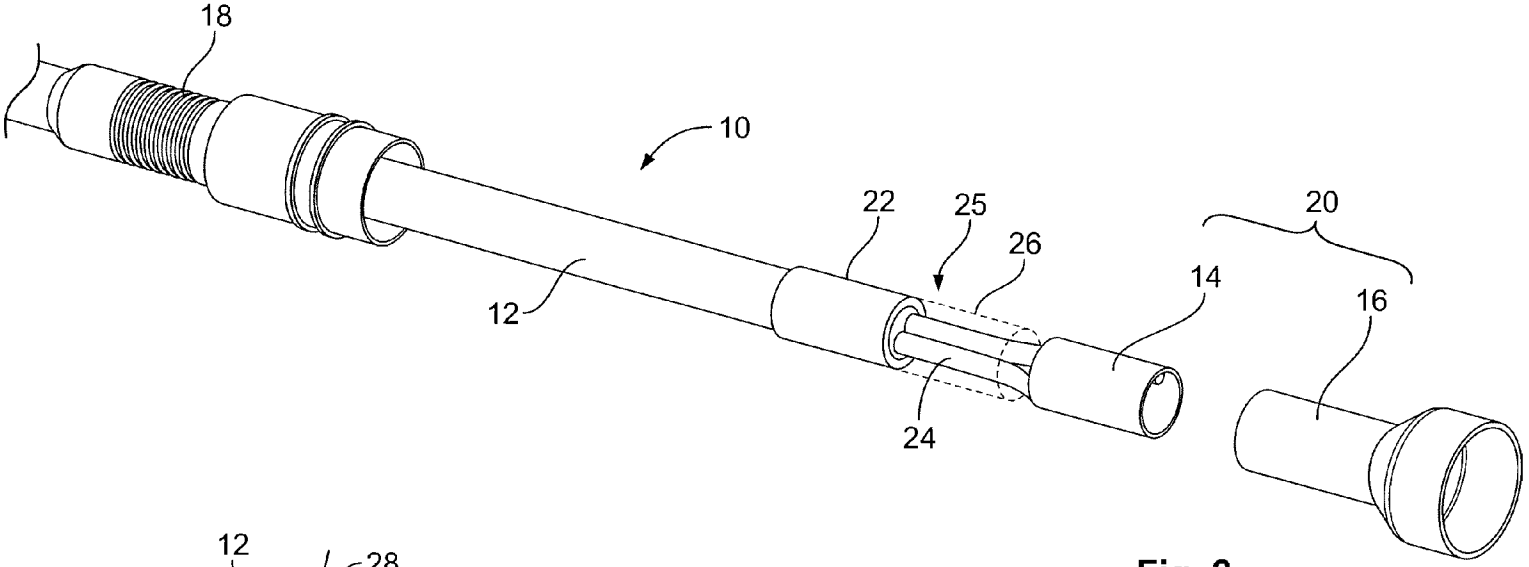
FIG. 2 shows a schematic and perspective rendition of parts of the enclosure assembly of FIG. 1.

FIG. 2 shows the components that are part of a fixed subassembly 10 of the enclosure assembly 1. The components of the fixed subassembly 10 are, at least in their final, operational state, fixed with respect to a cable 12. The components of the fixed subassembly 10 comprise a shielding sleeve 14, a shielding ferrule 16, and a strain relief 18. The shielding sleeve 14 and the shielding ferrule 16 may together form a fixed shielding substructure 20, that is part of the electromagnetic shielding structure of the enclosure assembly 1. The parts of the fixed shielding substructure 20 are preferably made from a solid-wall, tubular material, such as bronze, in particular phosphor bronze, which may be nickel-plated.

As can be seen in FIG. 2, strands 24 are exposed at a forward end 25 of the cable 12. At the end of the strands 24, the isolation may have been removed already.

Further, the cable shield 22 is exposed at the forward end 25. Preferably, the cable shield 22 may be left in place at the cable section where the strands 24 have been exposed, thus giving an extra length 26 of cable shield 22, as indicated by the phantom lines.

The strain relief 18 is made from a plastic material. It may be ready-made element, or be moulded or shrunk at the site.

Figure 3:
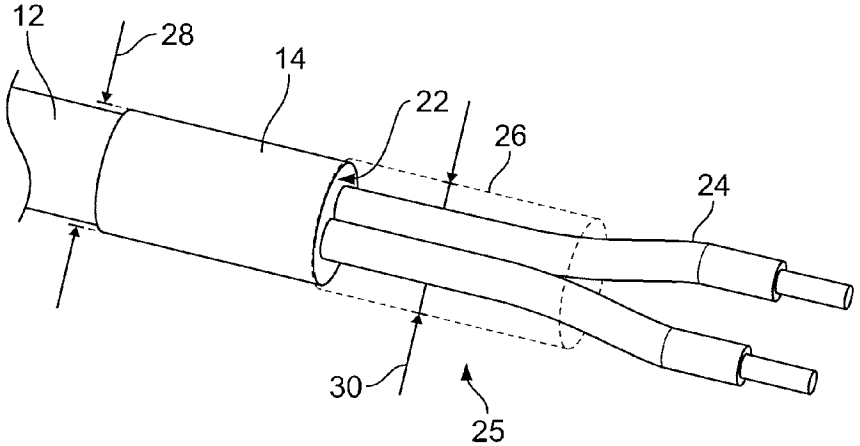
FIG. 3 shows a schematic and perspective rendition of a first assembly step for the enclosure assembly of FIG. 1.

The first assembly step for an on-site assembly of the parts of the sealing enclosure 1 shown in FIG. 1 is depicted in FIG. 3. Here, the shielding sleeve 14 has been slid over the forward end of the cable, where it is preferably situated above the exposed cable shield 22. As indicated by the phantom line, there may be an excess length 26 of the cable shield 22 in the end region of the cable 12, where the strands 24 have been exposed.

An inner diameter 28 of the shielding sleeve 14 is larger than an outer diameter 30 of the cable shield 22 on the cable 12, so that the shielding sleeve slides easily over the cable shield 22 onto the part of the cable 12, in which the cable shield 22 but not the strands 24 have been exposed previously.

The inner diameter 28 of the shielding sleeve 14 is, however, small enough to ensure electrically conductive contact over a large area between the shielding sleeve 14 and the cable shield 22. The cable shield 22 may have a braided configuration or be made from foil, or comprise a combination of both.

Figure 4:
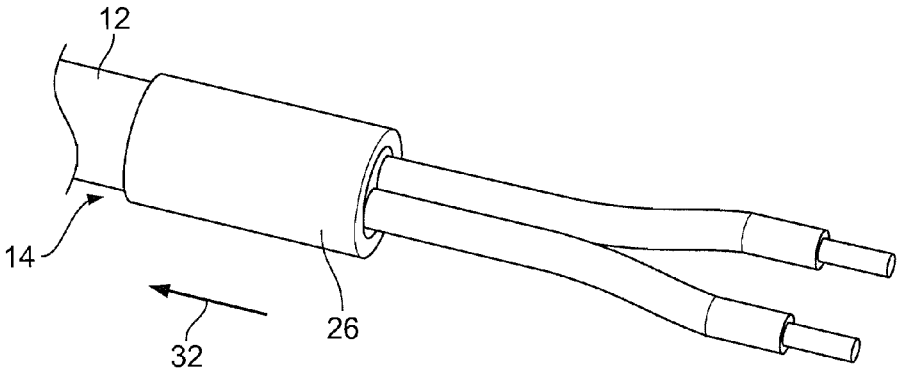
FIG. 4 shows a schematic and perspective rendition of a second assembly step of the enclosure assembly of FIG. 1.

In the second assembly step as shown in FIG. 4, the excess cable shield shown at 26 in FIG. 3 has been folded over in the rearward direction 32, so that it is, at least partly, preferably completely surrounding the outer, in particular cylindrical, surface of the contact sleeve 14.

The contact sleeve 14 serves to stabilize the end portion of the cable 12 and to provide a support and improved contact for the shielding ferrule 16 shown in FIG. 2.

Figure 5:
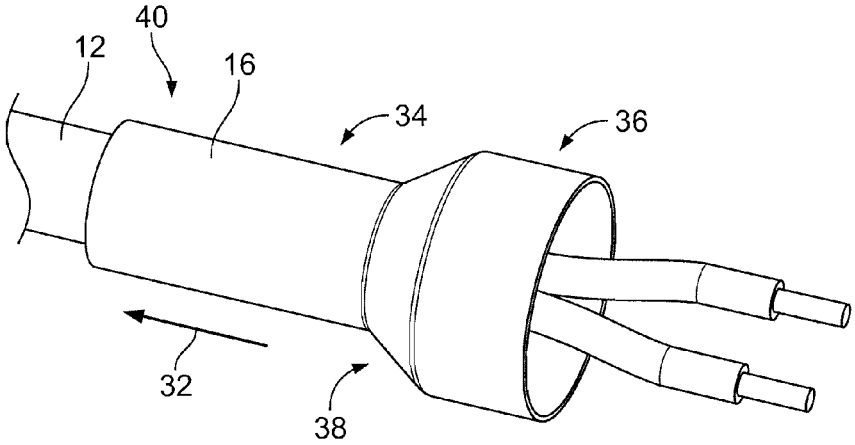
FIG. 5 shows a schematic and perspective rendition of a third assembly step of the enclosure assembly of FIG. 1.

Next, as shown in FIG. 5, the shielding ferrule 16 is slid in the rearward direction 32 over the cable 12, the shielding sleeve 14 and the cable shield 22 put over the shielding sleeve.

The shielding sleeve 14 together with the excess cable shield 26 on the outer peripheral surface of the shielding sleeve 14 is accommodated within the shielding ferrule 16 with a little play. Thus, the shielding ferrule is slid easily over the shielding sleeve 14 without delocating the sleeve 14 or the cable shield 26.

As can be further seen from FIG. 5, the shielding ferrule may be of essentially tubular shape and has two sections 34 and 36 which are cylindrical. The rearward cylindrical section 34 may have a smaller diameter than the forward cylindrical section 36. Between the cylindrical sections 34, 36, a middle section 38 may be arranged. The middle section 38 may be of frustoconical shape tapering in the rearward direction 32.

Once the shielding ferrule 16 is in place with the small-diameter cylindrical section 36 or its rearward end 40 being situated over the exposed cable shield 22, and/or the shielding sleeve 14, and in electrical contact therewith, the strain relief 18 is put in place. The strain relief 18 may have been slid over the cable 12 in the rearward direction 32 before the shielding sleeve 14 and/or the shielding ferrule 16 have been put on the cable 12. At the end of the assembly step shown in FIG. 5, the strain relief 18 is slid in a forward direction 42 along the cable, until its forward portion 43 engages the rearward section 34 of the shielding ferrule 16. For this, the forward portion 43 of the strain relief 18 may be widened elastically to hold the shielding ferrule 16 in a fixed position relative to the forward/rearward direction 32, 42. Alternatively, or in addition, heat may be applied to the strain relief 18 if it contains or is made from a heat-shrink material. Also, the strain relief 18 may be moulded around the cable 12 and at least the rearward section 24 of the shielding ferrule 16 on site. The strain relief 16 may extend and cover also the middle section 38.

Independently of its configuration, the strain relief 18 serves to hold the shielding ferrule 16 and thus at least part of the fixed shielding substructure 20 on the cable 12. Preferably, the strain relief 18 also seals off any gap between the cable 12 and an interior of the electromagnetic shielding structure at the rearward end.

The shielding sleeve 14 within the shielding ferrule 16 is preferably not fixed by the strain relief 18. Rather, it is preferred that the shielding sleeve 14 has a movability relative to the shielding ferrule 16 or the remainder of the shielding structure so that tolerances may be compensated. In particular, the sleeve may be held only by the cable shield 26

Figure 7:
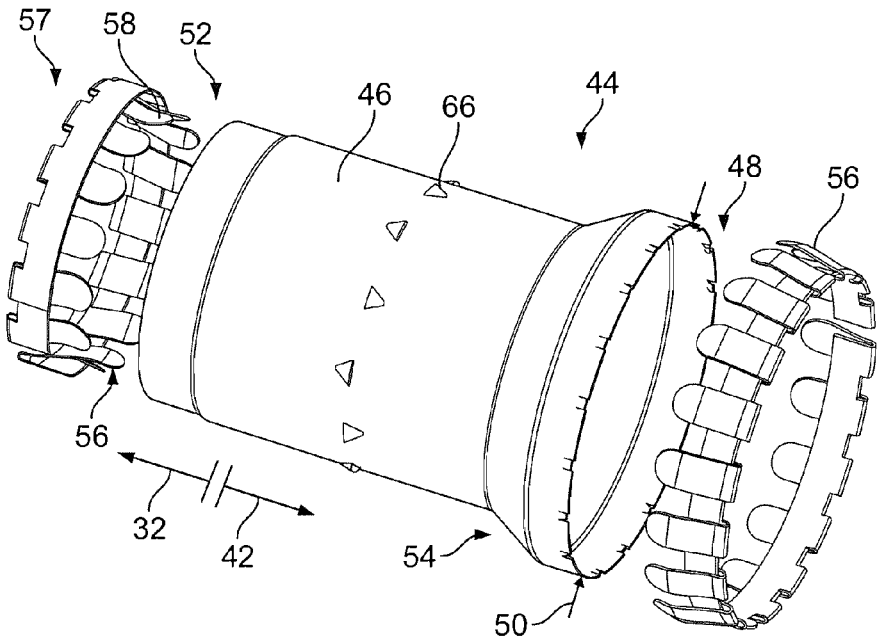
FIG. 7 shows a schematic and perspective rendition of another assembly step of the enclosure assembly of FIG. 1.
Figure 9:
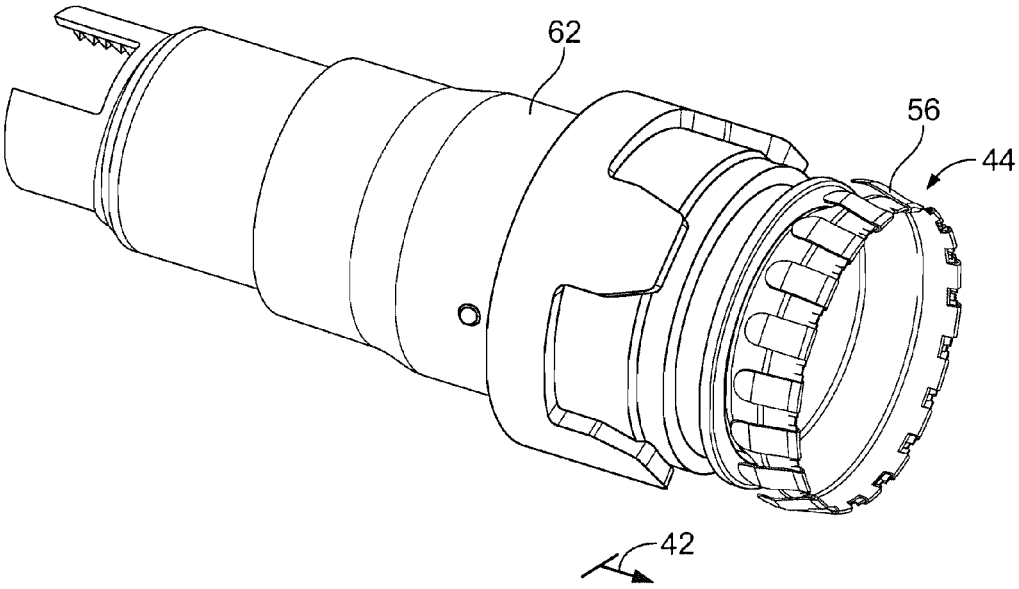
FIG. 9 shows a schematic and perspective rendition of an assembly step subsequent to the assembly step of FIG. 8.
Figure 8:
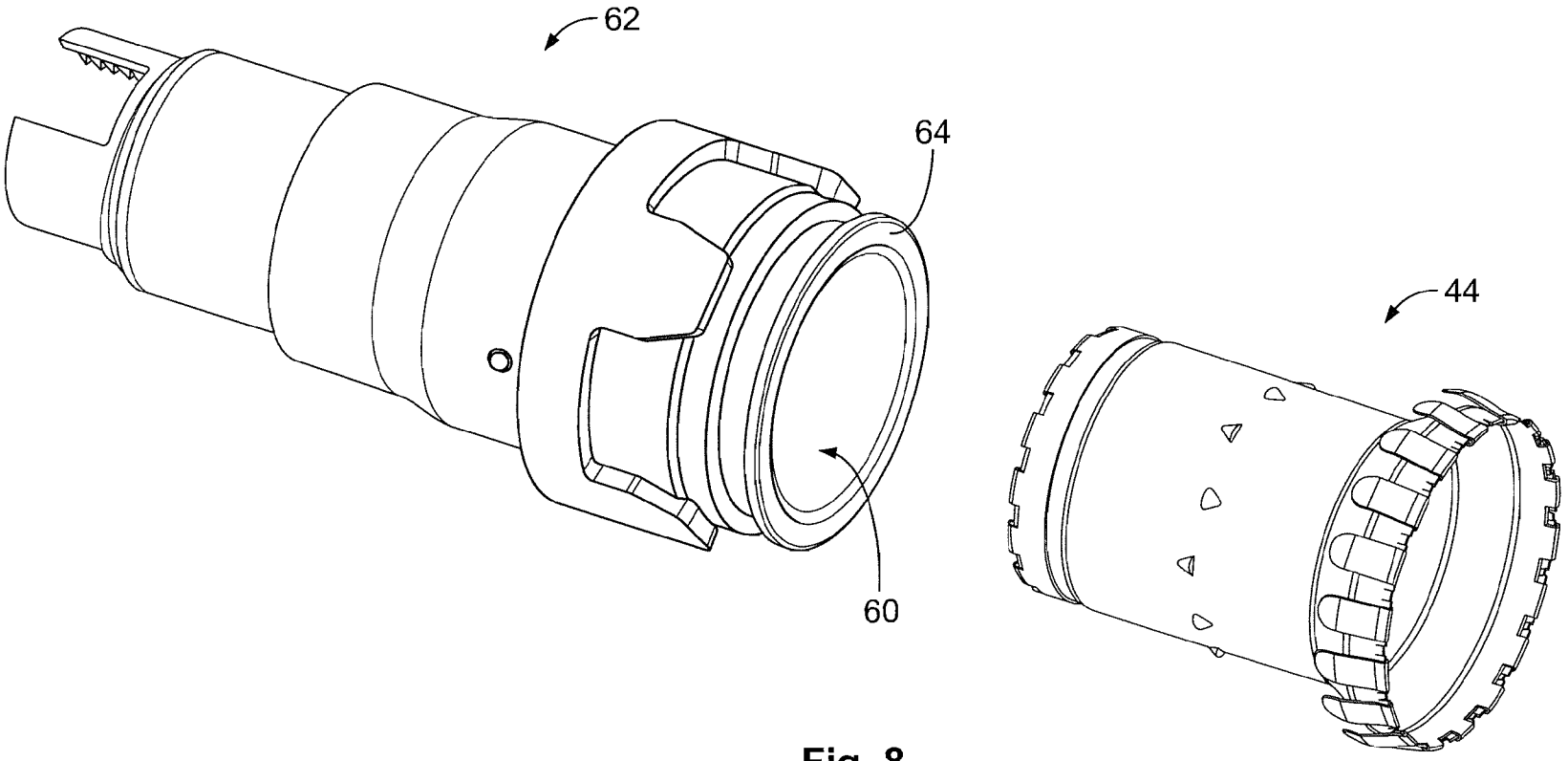
FIG. 8 shows a schematic and perspective rendition of an assembly step subsequent to the assembly step of FIG. 7.

Further, the enclosure assembly 1 may be provided with a moveable shielding substructure 44, which is explained, by way of example only, with reference to FIGS. 7 to 9.

The elements constituting the moveable shielding substructure 44 may, in a modification, also be integrated into the fixed shielding substructure 20, e.g. by elongating the large-diameter cylindrical section 34 of the fixed shielding substructure 20.

However, it is believed that the division of the shielding structure resulting from the combination of the fixed and the moveable shielding substructures 20, 44 results in an easier handling and especially an easier mounting of the connector on the strands 24, which would be otherwise covered by the large-diameter cylindrical section 34. Thus, the cable strands 24 remain accessible, as e.g. seen in FIG. 6.

The moveable shielding substructure 44 comprises a shielding element 46 of essentially tubular shape. The shielding element 46 may preferably be made from a bronze material, such as phosphor bronze. The shielding element 46 may be plated with nickel.

The shielding element 46 is preferably made from a solid-walled body, thus providing the enclosure assembly 1 with an additional protective shell. At a forward end 48, the shielding element 46 may have a larger inner and/or outer diameter 50 than at a rearward end 52. A transition region 54 between the large and the small diameter sections of the shielding element 46 may taper in the rearward direction 32, respectively have a frustoconical shape. The rearward contact spring is accessible from a radial inward position, whereas the forward contact spring may be accessed from a radial outward position.

At least one end of the moveable shielding substructure 44, at least one contact spring 56, which is radially deflectable, may be provided. A contact spring 56 at the rearward end 52 serves to contact the fixed shielding substructure 20. A contact spring 56 at the forward end 48 serves to contact a mating enclosure, which may be a bulkhead on a cabinet 2 shown in FIG. 1.

The contact spring 56 may be part of a separate element, such as a ring-like spring member 57. The ring-like spring member 57 may form a receptacle, into which the ends 48 and/or 52 of the shielding element 46 may be pressed.

As can be seen from FIG. 7, the ring-like structures 57 comprise a plurality of contact springs 56 which are arranged side-by-side along the peripheral direction.

Each contact spring 56 may comprise a tongue 58 which points in the forward/rearward direction 32, 42.

At the rearward end 52, the contact springs 56 may project radially inwards and be situated at an inner surface of the shielding element 6. At the forward end 48, the contact springs 56 may be arranged on the outer surface of the shielding element 46. The tongues 58 may be elastically pressed against the shielding element 46.

Of course, the contact springs 56 may also be integrally formed by the shielding element 46. It is believed, however, that this increases resistance and weakens the rigidity of the shell-like structure of the shielding element 46.

FIG. 8 shows the moveable shielding substructure 44 in a pre-assembled state. Once the moveable shielding substructure 44 is complete, it is inserted into a forward opening 60 of an inner body 62 of the enclosure assembly 1. The inner body is open in the forward and rearward direction so that the cable 12 may extend therethrough.

This insertion may take place before the inner body 62 is slid onto the cable 12 in the rearward direction 32, or at a later stage, e.g. when the inner body 62 is placed on the cable. Preferably, the inner body 62 is slid onto the cable 12 before the strain relief 18 and/or before the shielding sleeve 14 and/or the shielding ferrule 16 are mounted on the cable end (see FIGS. 3 to 6).

Once the moveable shielding substructure 44 has been inserted into the inner body 62 the configuration shown in FIG. 9 results. As can be seen, the electromagnetic shielding structure, of which the moveable shielding substructure 44 may be a part, may project in the forward direction 42 from the inner body 62. The contact springs 56 of the moveable shielding substructure 44, may form around a forward end 64 (cf. FIG. 8) of the inner body 62. Protrusions 66 (cf. FIG. 7) of the shielding element 46 may engage the inner wall of the inner body 62. The protrusions 66 and/or the contact springs 56 abutting and being turned around the rim-like forward end 64 of the inner body 62 help to keep the moveable shielding substructure 44 firmly in place.

The inner body 62, preferably together with the moveable shielding substructure, is then moved along the cable 12 in the forward direction over the fixed shielding substructure 20 fixed onto the cable 12. Finally, an outer body 68, which serves an outer protective shell and as a handling device for operating a locking element 70 for locking the enclosure assembly 1 to a mating assembly 3 (see e.g. FIG. 10), is slid over the inner body.

If the inner body 62 is slid over the fixed shielding substructure 20, a connection to the moveable shielding substructure 44 is established automatically. Once the outer body has reached its operation position, the inner body is automatically fixed with respect to the cable. For this, the outer body 68 comprises at a rearward end 71 an actuation surface 72 that is pressed against a radially deflective locking member 73 of the inner body 62. The locking member 73 is thus brought into engagement with the strain relief for a frictional and/or positive lock.

If the resulting enclosure assembly 1 is coupled to mating enclosure, such as the bulkhead 2, the picture shown in FIG. 1 results.

Figure 10:
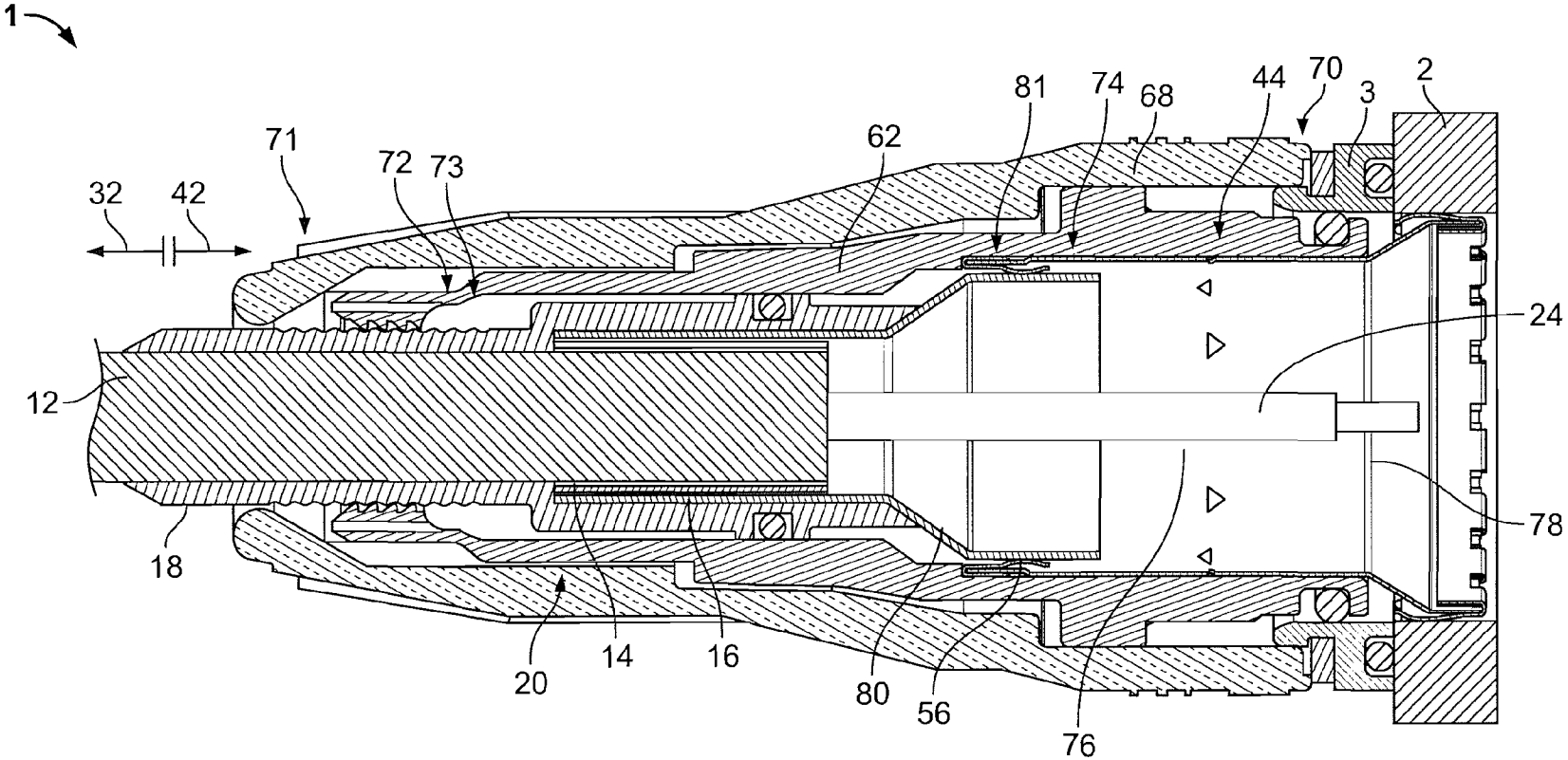
FIG. 10 shows a schematic rendition of the enclosure assembly of FIG. 1 in a cut along a centre plane.

FIG. 10 shows a cut along the centre plane of an assembled enclosure assembly 1 mounted on a bulkhead 2 via the mating enclosure 3, i.e. the enclosure assembly in an operating state. The mating enclosure 3 may be a bulkhead which is mounted e.g. on a cabinet.

As can be seen, there is play both between the shielding sleeve 14 and the cable 12 and between the shielding sleeve 14 and the shielding ferrule 16.

Further, the overall electromagnetic shielding structure 74 is received within the inner body 62 thereby forming an outer wall 76 of a connector volume 78. In the particular embodiment shown, the outer wall 76 may be formed by the moveable shielding substructure 44, which may be moved along the cable over the fixed shielding substructure 20. A rearward wall 80 of the connector volume 78 is also formed by the electromagnetic shielding structure 74, in particular the fixed shielding substructure 20, respectively a frustoconical part thereof, namely the middle section 38. The fixed shielding substructure is located at a rearward section 81 of the connector volume 78.

The fixed shielding substructure 20 and the moveable shielding substructure 44 are connected to each other via the at least one contact spring 56 arranged between an outer peripheral surface of the fixed shielding substructure 20 and the moveable shielding substructure 44. This connection is located preferably at the rearward end section 81 of the connector volume 78.

The wall thickness of the moveable shielding substructure 44, which may be generally of larger diameter than the fixed shielding substructure 20, may be thinner than the wall thickness of the fixed shielding substructure 20: Due to the larger diameter, the cross-sectional area of the moveable shielding substructure 44 perpendicular to the forward/rearward direction 32/42 is larger than the cross-sectional area of the fixed shielding substructure 20. The cross-sectional areas of the fixed and the moveable shielding substructures 20, 44 result in a large conductive area so that very low DC resistances can be achieved.

To allow for sufficient space in the connector volume 78 and a free movement of the connector mounted on the ends of the strands 42, the fixed shielding substructure 20 extends, at the rearward section 81, only a short section into the forward direction and into the connector volume 78.

Further, it can be seen that the tapered middle section 38 of the fixed shielding substructure 20, together with the strain relief being located on the middle section 38, form a stop for the inner body 62. This prevents the inner body 62 from falling off inadvertently from the cable 12.

Figure 11:
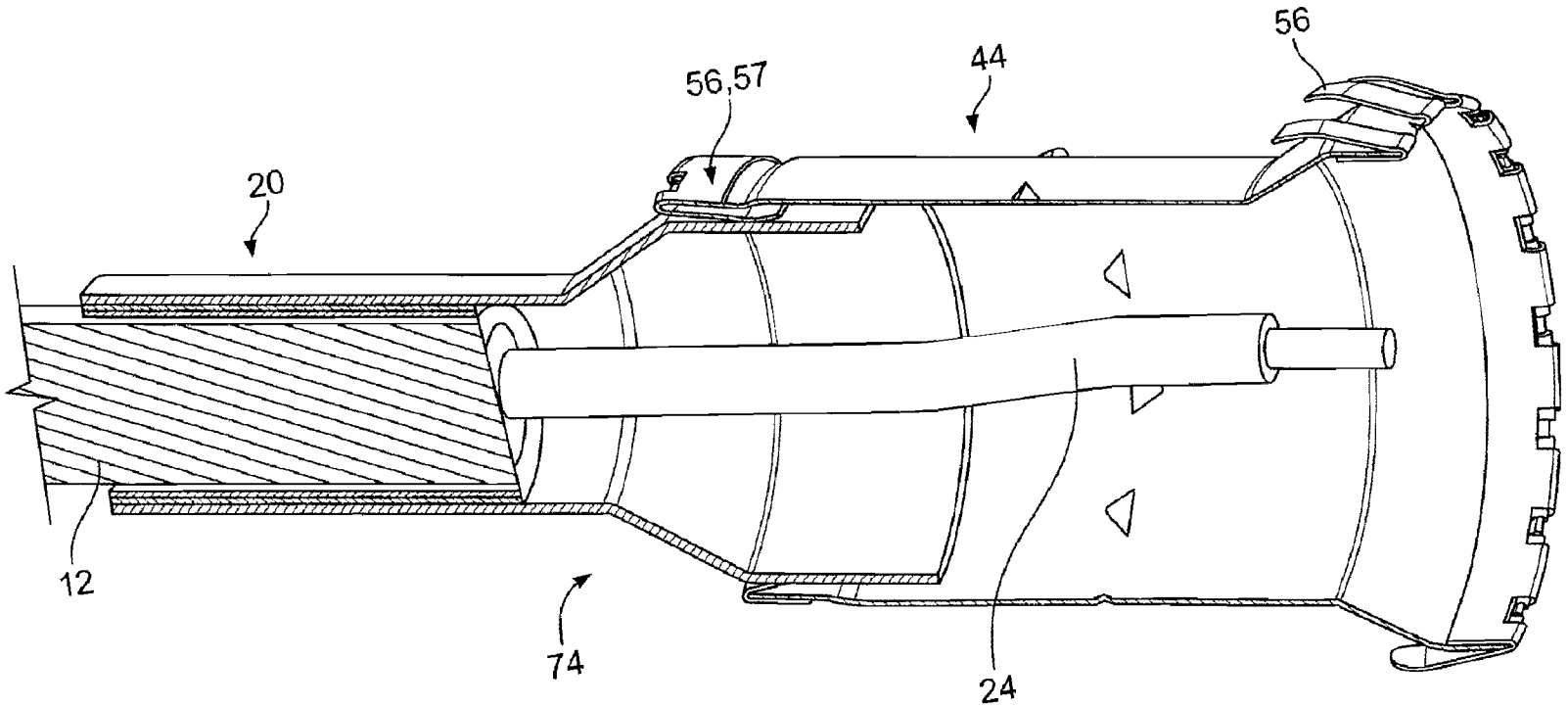
FIG. 11 shows a schematic and perspective rendition of an electromagnetic shielding structure according to the invention.

An additional advantage results from the spring contacts 56, being positioned at positions where the shielding structure has large diameters. This allows a large number of contacts 56 to be placed side-by-side to each other as shown in FIG. 11. Thus, a high contact force may be maintained over time and at the same time, a large transitional cross-section for currents passing between the fixed shielding substructure 20 and the moveable shielding substructure 44. This leads to a low DC resistance as well as a good ESD performance, for example in case of lightening strikes. In particular, the DC resistance value of the embodiment shown in several milliohms only.

Figure 6:
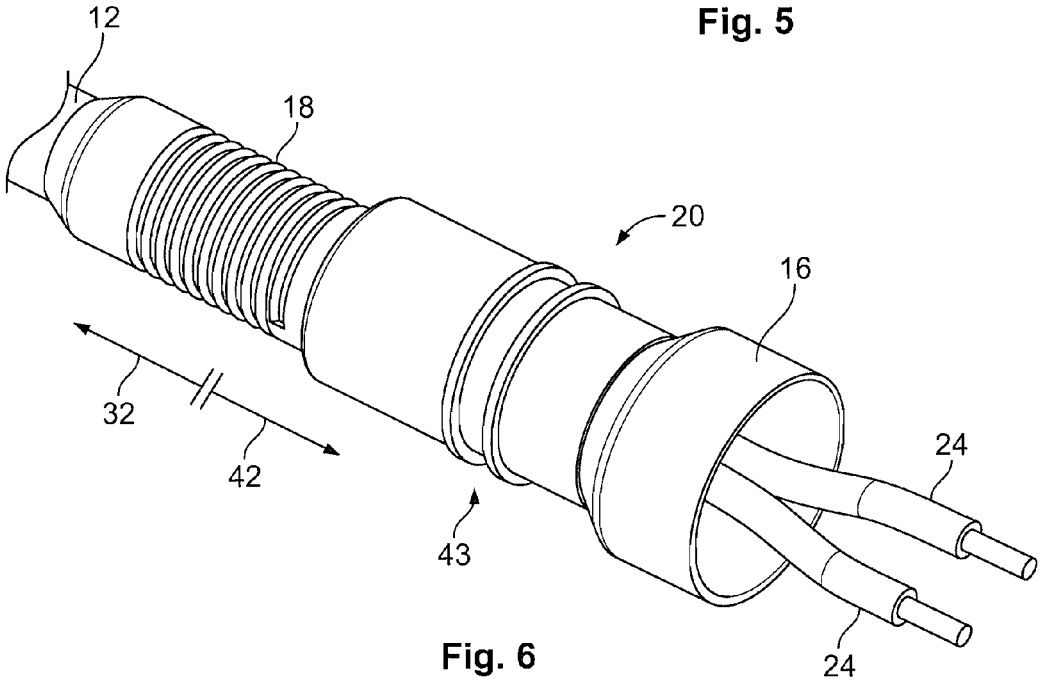
FIG. 6 shows a schematic and perspective rendition fourth assembly step for the enclosure assembly of FIG. 1.
Figure 12:
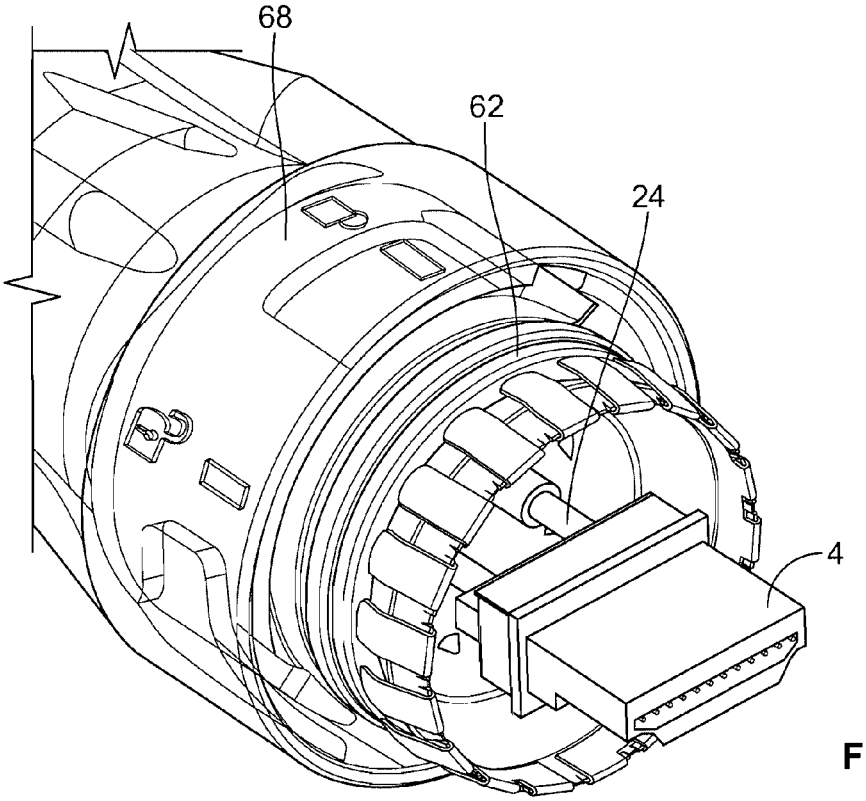
FIG. 12 shows a schematic and perspective rendition of the enclosure assembly of FIG. 1 with a standardized connector located in a connector volume.

Preferably after the assembly step of FIG. 6, when the strands 24 are easily accessible, the connector 4 may be mounted on the ends of the strands 24 as shown in FIG. 12. The connector 4 is received loosely within the connector volume 78 so that positional tolerances between the mating enclosure and the mating connector may be compensated by shifting the connector 4 within the connector volume 78.

Figure 13:
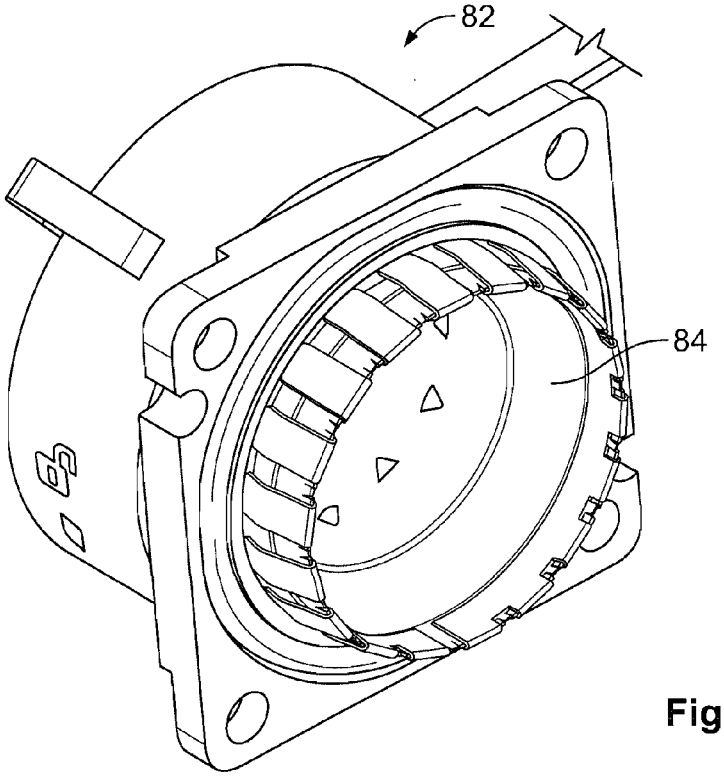
FIG. 13 shows a schematic and perspective rendition of a cap for the enclosure assembly of FIG. 1.
Figure 14:
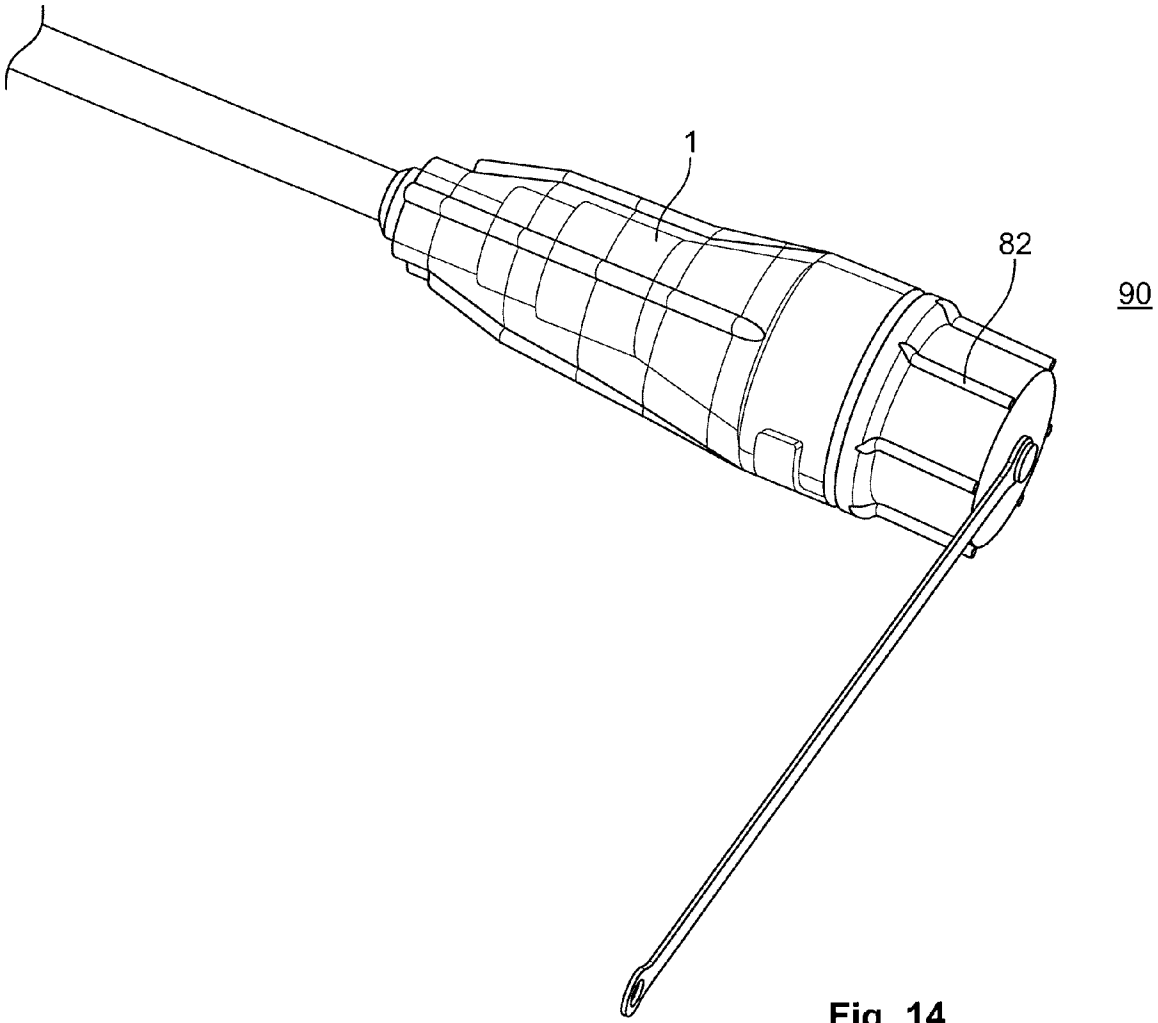
FIG. 14 shows a schematic and perspective rendition of the enclosure assembly of FIG. 1 having a dust cap of FIG. 13 mounted thereon.

If the enclosure assembly 1 is not connected to a mating enclosure or bulkhead, it may be necessary to provide a cap 82 which is placed on the mating enclosure or the enclosure assembly 1. The cap 82 as shown in FIGS. 13 and 14 has a shielding structure 84, which is essentially pot-like.

Figure 15:
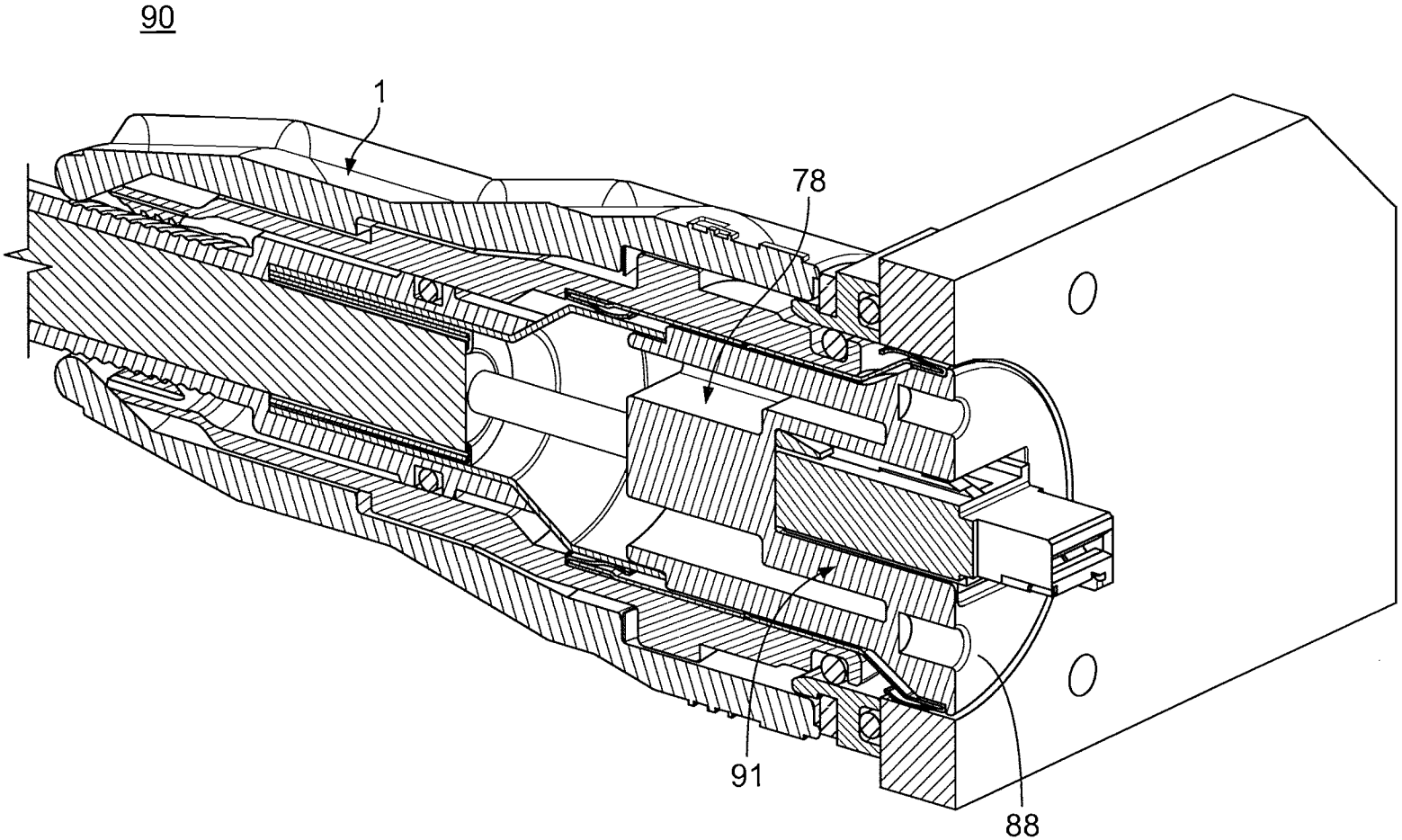
FIG. 15 shows a schematic and perspective rendition of the enclosure assembly of FIG. 1 with an alignment adapter and mounted onto a bulkhead in a cut along the outer plane.

Finally, FIG. 15 shows a modification of the enclosure assembly 1. Here, an alignment adapter 88 is inserted into the connector volume 78. Preferably, the alignment adapter 88 fills out completely the forward opening 89 of the connector volume 78, thus, effectively sealing the connector volume 78 in the forward direction against an outer environment 90.

The alignment adapter 88 is provided with a complementary receptacle 91 for at least one connector or counter-connector. The alignment adapter 88 is arranged inside the electromagnetic shielding structure.

The enclosure assembly 1 as described above has the advantage that the connector 4 within the connector volume 78 can be mounted onto the strands 24 without having to pay attention to any interfering shielding structure. Due to the division of the shielding structure 74 into a fixed and a moveable substructure 20, 44, the shielding may be completed after the connector has been mounted. This completion is performed automatically if the inner body is slid forward into its operating position. The fixed and the moveable shielding substructures contact each other automatically during this forward motion of the inner body 62, at least once the operation position is reached by the inner body.

If a facilitated access to the connector 4 is not important, an emphasis may be put on low manufacturing costs. Here, a unitary electromagnetic shielding structure, in which the shielding ferrule 16 and the shielding element 46 are a single integrated element fixed onto the cable, may be of advantage. For this modification, the above description also applies mutatis mutandum.

The embodiments described above are particularly suited for a power connector.

Although, in the above, certain structures have been described as "substructures", this does not require that these structures are part of another structure. If only a fixed shielding structure or only a magnetic structure is present, these substructures may constitute the whole electromagnetic shielding structure.

Figure 16:
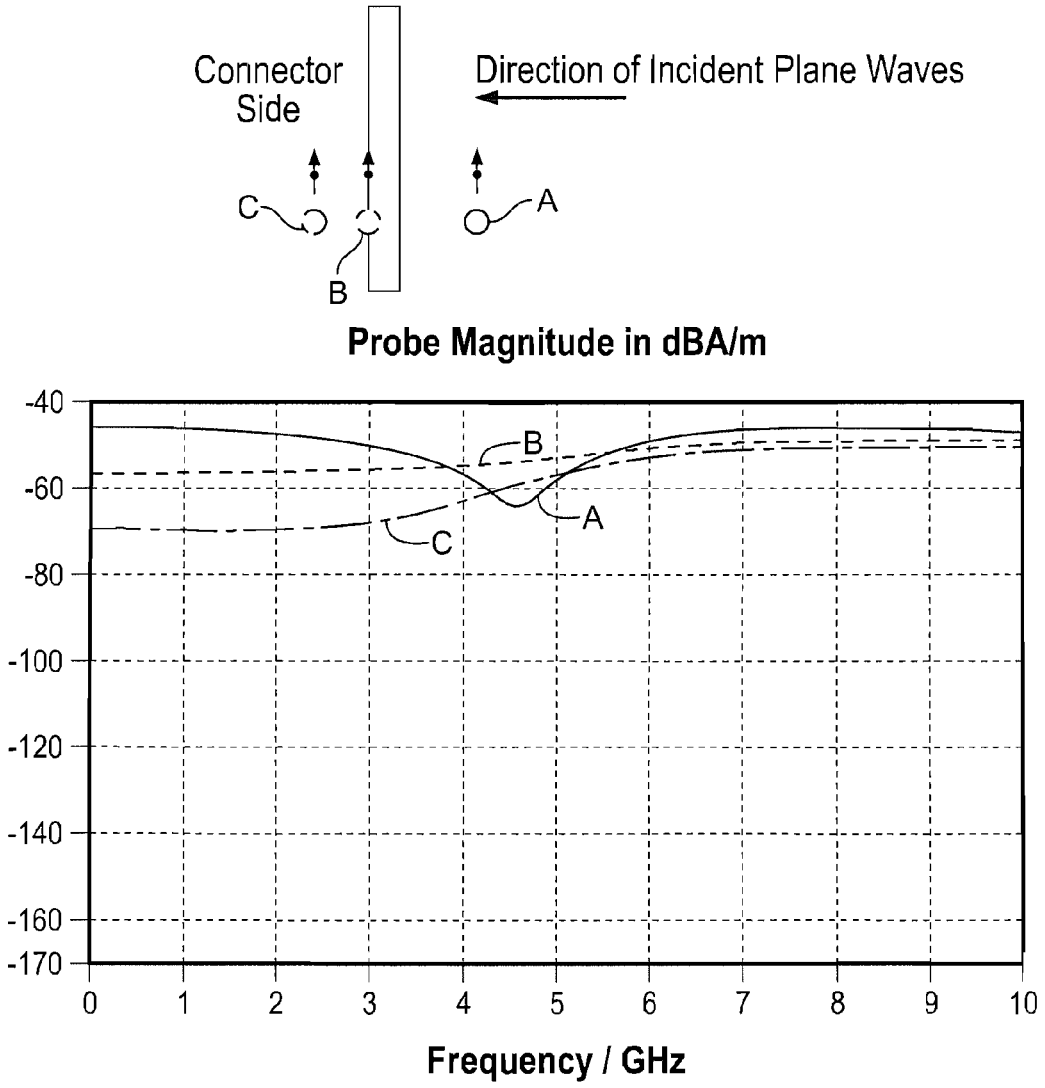
FIG. 16 shows a schematic representation of the shielding efficiency of an enclosure assembly without a shielding structure.
Figure 17:
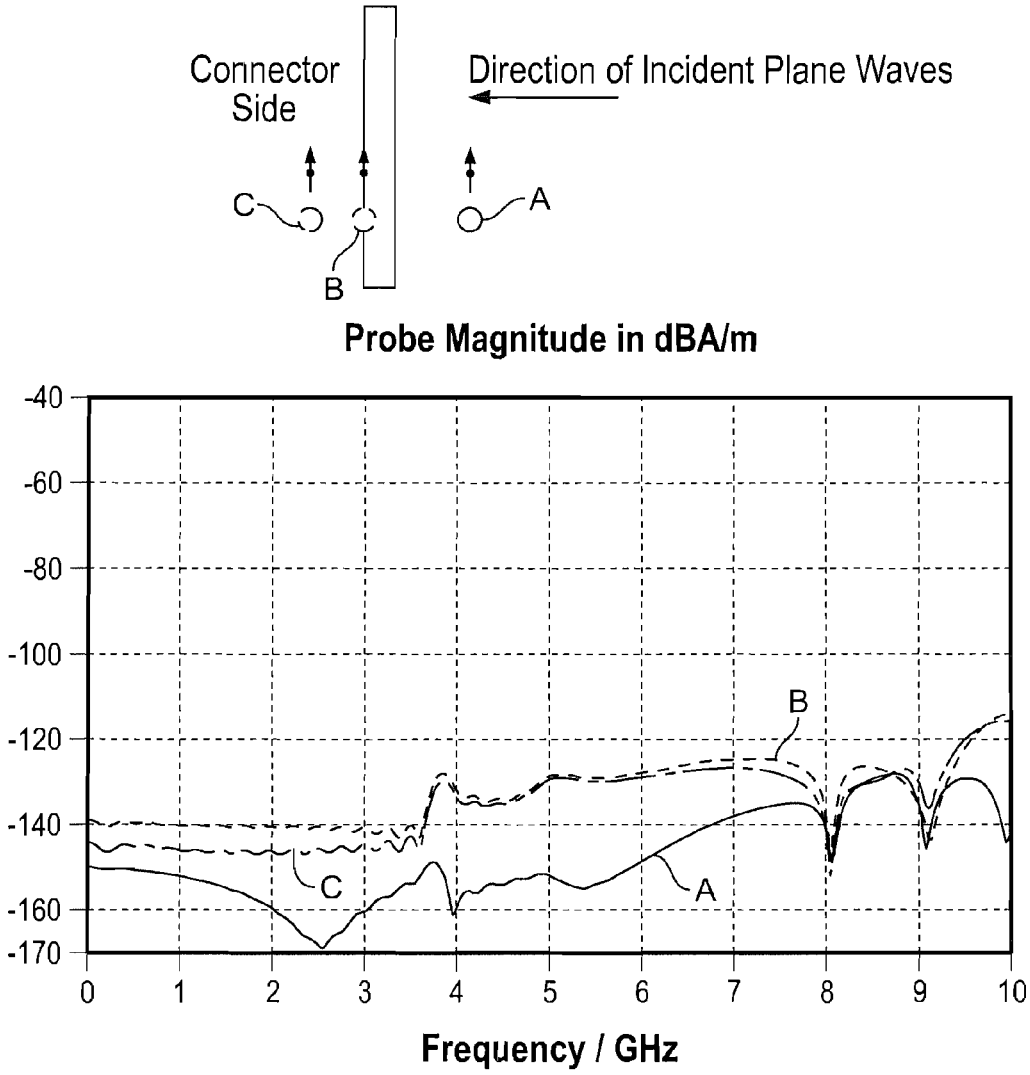
FIG. 17 shows a schematic representation of the shielding efficiency of an enclosure assembly with a shielding structure according to the invention.

The shielding effectiveness of the enclosure assembly according to the invention can be seen from the comparison of FIGS. 16 and 17.

FIG. 16 shows the strength of an electromagnetic field propagating in the rearward direction and oriented in a direction perpendicular to the forward/rearward direction 32, 34, measured at three locations, over frequency. The measurement locations are spaced along the axis of the enclosure assembly located forward of the enclosure assembly, line A, in the plane of the forward opening of the enclosure assembly, line B, and spaced from the forward opening in the rearward direction, line C. In FIG. 16, the enclosure assembly does not have an electromagnetic shielding structure.

FIG. 17 shows the same measurement with the difference being that the enclosure assembly is provided with an electromagnetic shielding structure 74.

As can be seen from the comparison of FIGS. 16 and 17, the strength of the electromagnetic field within the enclosure assembly is reduced by approximately −70 dB over a wide range of even very high frequencies. This provides for very efficient shielding.

The invention claimed is:

1. Enclosure assembly for at least one of a variety of in particular standardized connectors on a cable, the enclosure comprising a connector volume located within an inner body of the enclosure, the connector volume being adapted to moveably accommodated the at least one standardized connector, the inner body being open to an outer environment in a forward and a rearward direction, and an outer body adapted to slide over the inner body in the forward direction, the outer body comprising at least one locking element for securing the enclosure assembly to a mating enclosure, wherein the connector volume is located within an electromagnetic shielding structure, the electromagnetic shielding structure being located within the inner body and is at least in parts slideably engaged within the inner body in the forward direction and to be contacted with a mating connector.

2. Enclosure assembly according to claim 1, wherein the electromagnetic shielding structure comprises a moveable shielding substructure, which is adapted to be held, at least with respect to a movement of the inner body in the forward direction, by the inner body.

3. Enclosure assembly according to claim 1, wherein the electromagnetic shielding structure comprises a fixed shielding substructure which is adapted to be fixed on the cable and a moveable shielding substructure, adapted to be slid over the fixed shielding substructure in the forward direction.

4. Enclosure assembly according to claim 3, wherein the fixed and the moveable shielding substructures are automatically connected to each other in an electrically conductive manner during a movement of the inner body in the forward direction.

5. Enclosure assembly according to claim 3, wherein the fixed and the moveable shielding substructures are connected to each other by at least one contact spring.

6. Enclosure assembly according to claim 3, wherein the fixed and the moveable shielding substructures are connected to each other at a rearward section of the connector volume.

7. Enclosure assembly according to claim 1, wherein the electromagnetic shielding structure forms a rearward wall of the connector volume.

8. Enclosure assembly according to claim 1, wherein the electromagnetic shielding structure comprises, at a forward end, at least one contact spring.

9. Enclosure assembly according to claim 5, wherein a plurality of contact springs is provided in a ring-like configuration.

10. Enclosure assembly according to claim 1, wherein the electromagnetic shielding structure comprises a shielding ferrule, the shielding ferrule at its rearward section being in contact with a cable shield.

11. Enclosure assembly according to claim 1, wherein the electromagnetic shielding structure comprises a shielding ferrule, the shielding ferrule tapering in a rearward direction.

12. Enclosure assembly according to claim 1, wherein the electromagnetic shielding structure is, at its rearward section, being fixed to the cable.

13. Enclosure assembly according to claim 10, wherein the electromagnetic shielding structure comprises a shielding sleeve, the shielding sleeve being adapted to be slid over and be in contact with a cable shield.

14. Enclosure assembly according to claim 13, wherein an electrically conductive element is arranged between the shielding sleeve and the shielding ferrule.

15. Enclosure assembly in particular according to claim 1, wherein an alignment adapter is held within the connector volume, the alignment adapter providing a complementary receptacle for the at least one connector.

16. Enclosure assembly according to claim 15, wherein the alignment adapter closes off the connector volume in the forward direction.

17. An enclosure assembly according to claim 1, further comprising a cap wherein a pot-like electromagnetic shielding structure is provided.

18. Enclosure assembly for at least one of a variety of in particular standardized connectors on a cable, the enclosure comprising a connector volume located within an inner body of the enclosure, the connector volume being adapted to moveably accommodate the at least one standardized connector, the inner body being open to an outer environment in a forward and a rearward direction, and an outer body adapted to slide over the inner body in the forward direction, the outer body comprising at least one locking element for securing the enclosure assembly to a mating enclosure, wherein the connector volume is located within an electromagnetic shielding structure, the electromagnetic shielding structure being located within the inner body, and wherein the electromagnetic shielding structure comprises a fixed shielding substructure electrically commoned to a moveable shielding substructure, the fixed shielding substructure being adapted to be fixed on the cable and the moveable shielding substructure being adapted to be slid over the fixed shielding substructure in the forward direction.

19. Enclosure assembly according to claim 18, wherein the fixed and the moveable shielding substructures are electrically commoned to each other by at least one contact spring.

* * * * *